US006382361B2

(12) United States Patent
Nihei et al.

(10) Patent No.: US 6,382,361 B2
(45) Date of Patent: May 7, 2002

(54) ELEVATOR

(75) Inventors: Hideki Nihei, Hitachiota; Hiroshi Nagase, Hitachi; Hiromi Inaba, Hitachinaka; Toshiyuki Tadokoro, Funabashi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/733,094

(22) Filed: Dec. 11, 2000

(30) Foreign Application Priority Data

Dec. 9, 1999 (JP) ..... 11-349786

(51) Int. Cl.[7] ..... B66B 1/06; B66B 1/28

(52) U.S. Cl. ..... 187/289; 187/293; 187/294; 187/413

(58) Field of Search ..... 187/277, 282, 187/283, 289, 293, 294, 413

(56) References Cited

FOREIGN PATENT DOCUMENTS

| | | | |
|---|---|---|---|
| JP | 57-112275 | * | 7/1982 |
| JP | 6-255959 | * | 9/1994 |
| JP | 7-137963 | * | 5/1995 |
| JP | 7-137964 | * | 5/1995 |

* cited by examiner

*Primary Examiner*—Stanley J. Witkowski
(74) *Attorney, Agent, or Firm*—Antonelli, Terry, Stout & Kraus, LLP

(57) ABSTRACT

An elevator system in which an elevator-car and a counter weight are suspended on a pulley system in a hoistway. The elevator system includes a receiving unit for receiving an electric power from a feeding unit provided in the hoistway, an inverter for converting the received electric power into ac power, a motor connected to an ac side of the inverter for driving the counter weight in up and down directions, a sensor for detecting a position of the receiving unit, and a control unit for controlling an inverter on the basis of the position detected by the position sensor. The counter weight carries the receiving means, the inverter, and the motor.

9 Claims, 9 Drawing Sheets

ELEVATOR

BACKGROUND OF THE INVENTION

The present invention relates to an elevator system, and particularly to an elevator system in which a receiving unit is installed in a counter weight.

Japanese Patent Application Laid-Open No. 57-121568, discloses an elevator system in which a drive unit is installed in a counter weight of the elevator. A primary side of a linear motor and an inverter, and a battery charger are installed in the counter weight in this elevator system. This battery charger is connected to a main electric power source across a sonnet connector, when the counter weight stops at the bottom position, and-electric power is supplied to the battery charger.

Further, the Japanese Patent Application Laid-Open No. 5-294568 indicates that, when the elevator-car arrives at the stop floor, electric power is supplied to the elevator-car in a non-contact way.

It is required to stop the counter weight at a power feeding position with accuracy in order to feed electric power to the counter weight. Generally, the elevator-car is designed so as to stop accurately at each of the floors. However, to accurately stop the counter weight at a predetermined position has not been given consideration. As a result, there is a concern that it will not be possible to stop the counter weight accurately at the power feeding position, for example, because of rope expansion, making it impossible to supply electric power to the counter weight. There is no consideration of the problem which makes it impossible to supply electric power to the counter weight because of such rope expansion in Japanese Patent Application Laid-Open No. 57-121568.

In addition, mechanical parts are connected when feeding power, and the separation of the mechanical parts is repeated during the use of the system.

In the technology described in Japanese Patent Application Laid-Open No. 5-294568, it is not required to stop the counter weight with a high degree of accuracy because the electric power is fed to the elevator-car side. Thus, no consideration has been given to the problem of stopping the counter weight with high accuracy in consideration of the possibility of rope expansion caused by the use of the elevator.

SUMMARY OF THE INVENTION

An object of the present invention is to provide an elevator system in which electric power can be surely supplied to the counter weight of the elevator.

In order to attain the above-mentioned object, the elevator system of the present invention includes a receiving means for receiving electric power from a feeding means provided in a hoistway, an inverter for converting the received electric power into ac power, a motor connected to an ac side of the inverter for driving a counter weight in up and down directions, a means for detecting a position of the receiving means; and a means for controlling the inverter on the basis of the position detected by the position detecting means. The counter weight carries the receiving means, the inverter, and the motor.

DETAILED DESCRIPTION OF THE PREFERRED EMBODIMENTS

An embodiment of the present invention will be explained hereinafter with reference to the drawings.

Figure 1:
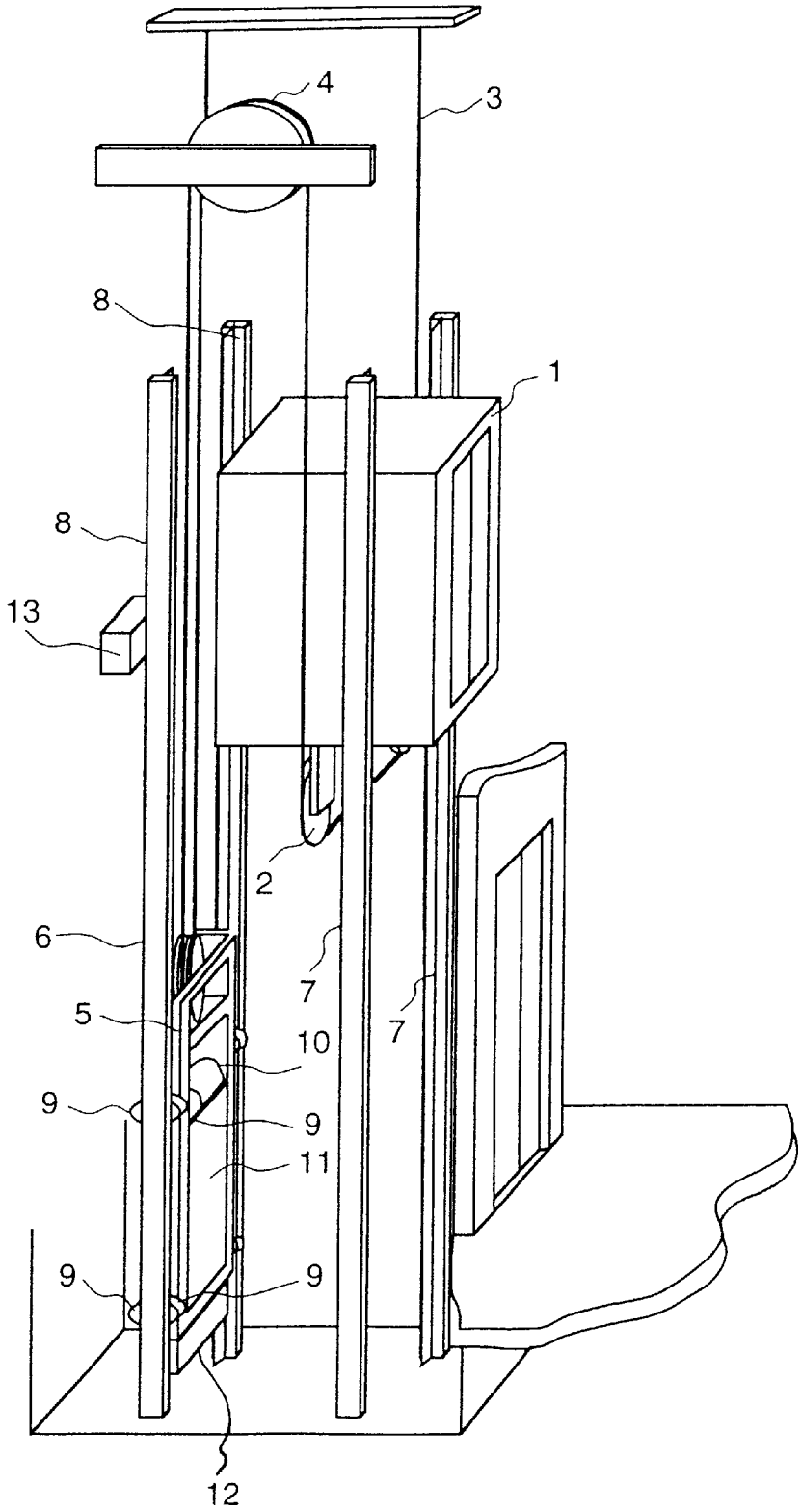
FIG. 1 is a perspective view of an elevator system according to an embodiment of the present invention.

FIG. 1 is a perspective view of an elevator system according to an embodiment of the present invention.

An elevator-car 1 has a pulley 2 mounted under the elevator-car. A rope 3 hangs from a top pulley 4 and passes around the lower side of pulley 2, while one end of the rope 3 is fixed to the top of a hoistway. Further, the rope 3 passes from the pulley 4 around a pulley 6 installed in the upper part of a counter weight 5. The other end of the rope 3 is also fixed to the top of the hoistway. In such a way, the elevator-car 1 and the counter weight 5 are suspended in the hoistway, respectively, by 2:1 roping.

The elevator-car 1 is constructed so as to be guided in a vertical direction freely by elevator-car rails 7 installed in up and down directions in the hoistway and the guide shoes or guide rollers (not shown) installed on the rail side of the elevator-car 1. In a similar way, the counter weight 5 is also guided in a vertical direction freely between guide-rails 8, which are installed in up and down directions of the hoistway, and rollers 9 installed on the guide-rail side of the counter weight.

Further, a rotary motor 10 for driving the counter weight 5 in up and down directions, a control panel 11 which controls the motor 10, and a damping unit 12 are installed in the counter weight 5. One of the rollers 9 is connected to the motor 10. In addition, a feed system 13 for supplying electric power to the control panel 11 of counter weight 5 is installed in the hoistway. This feed system 13 is installed at a position that is opposed to the position of counter weight 5 when the elevator-car has stopped at a predetermined standard floor (in this embodiment, the lowest floor). Therefore, when the elevator-car 1 stops at the standard floor, electric power is fed to the control panel 11.

Further, one of the rollers 9 which come in contact with the guide-rails 8 is connected to the motor 10, so that the counter weight 5 is moved up and down by the rotation of the roller 10. The elevator-car 1 moves up and down along with the movement of the counter weight 5. Further, when the elevator-car 1 stops at a floor, a damping unit 12 clamps guide-rail 8, and thus stops the counter weight 5.

Figure 2:
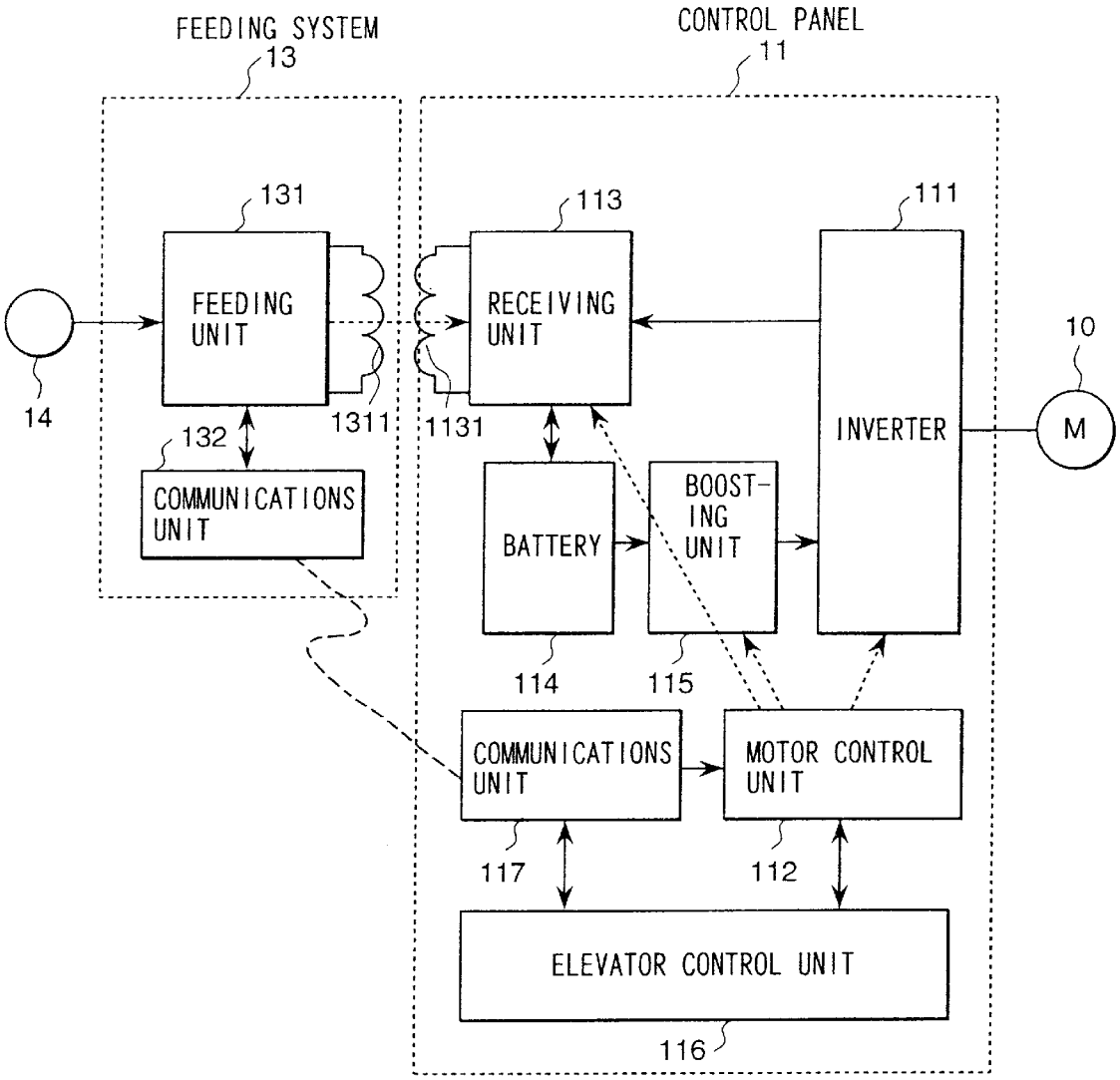
FIG. 2 is a block diagram showing the configuration of an electric system for the elevator system according to the embodiment of the present invention.

FIG. 2 is a block diagram showing the configuration of an electric system for the elevator system according to the embodiment of the present invention. The power feed system 13 is connected to the building power supply 14, and the control panel 11 is connected to the motor 10.

The control panel 11 comprises an inverter 111 for supplying three-phase ac power to the motor 10 to drive it; a motor control unit 112 for controlling the inverter 111; a battery 114 for storing electric power to drive the motor 10 via the inverter 111; receiving unit 113 for receiving a regenerative electric power from the inverter 111 and electric power from the receiving system 11 so as to charge the battery 114; a boosting unit 115 for boosting the output power of the battery 14 to a voltage for motor drive; elevator control unit 116 for applying a motor drive command to the motor control unit 112; and a communication unit 117 for communicating with the feeding system 13. The receiving unit 113 has transformer winding 1131.

The feeding system 13 is composed of a feeding unit 131 for supplying electric power received from the building power supply 14 to the receiving unit 113 through a transformer winding 1311 when it is necessary and possible to supply electric power; and, a communication unit 132 which communicates with the control panel 11.

In the above configuration, electric power is usually provided by the battery 114 to drive by the motor 10 to operate the elevator. When the transformer winding 1311 on the feed side and the transformer winding 1131 on the reception side are aligned, power may be transferred from the feeding unit 131 to the receiving unit 113; however, when the windings 1311 and 1131 are not aligned with a high degree of accuracy, it is not possible to feed the electric power efficiently from the feeding system 13 to the control panel 11.

Figure 3:
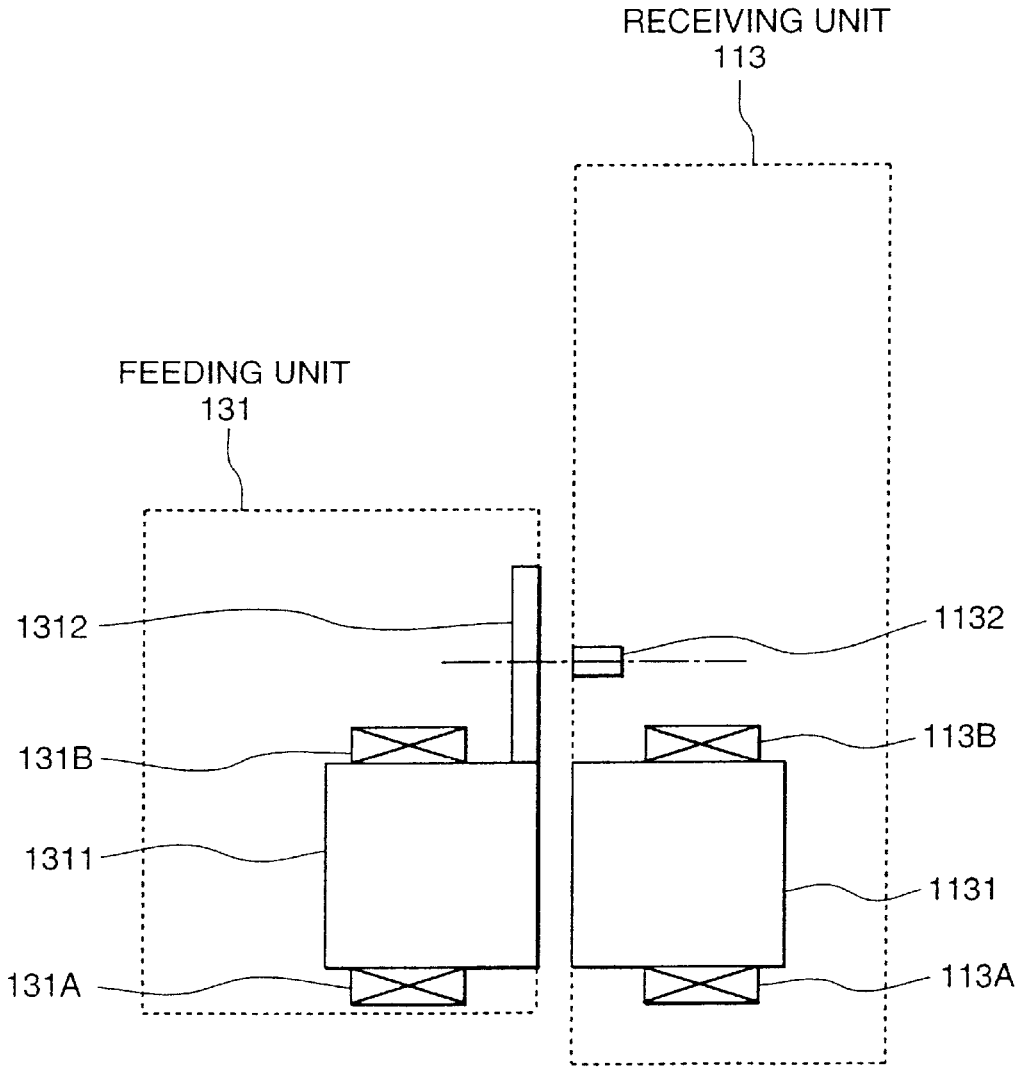
FIG. 3 is a schematic diagram showing the outline in section of a feeding unit 131 and a receiving unit 113.

FIG. 3 is a schematic diagram showing the outline in section of the feeding unit 131 and the receiving unit 113. A receiving transformer winding 1131 and a position sensing unit 1132 are built into the receiving unit 113, and a reference plate 1312 for sensing position and a feeding transformer winding 1311 are built into the feeding system 131. The feeding transformer winding 1311 is composed of a coil 131A and a core 131B, and the receiving transformer winding 1131 is composed of a coil 113A and a core 113B.

Position sensing unit 1132 is set so as to be able to detect a reference position when the receiving transformer winding 1131 and the feeding power transformer winding 1311 are correctly aligned relative to each other. As a result, the displacement from a reference position is detected, the motor 10 is driven, and thus the position of the counter weight is controlled to correspond at the position where the receiving transformer winding 1131 and the feeding power transformer winding 1311 are correctly aligned relative to each other.

As is well known, there are various kinds of position sensors, such as the light type and the magnetic type. An explanation of the details of such sensors is omitted here, since they are well known.

Figure 4:
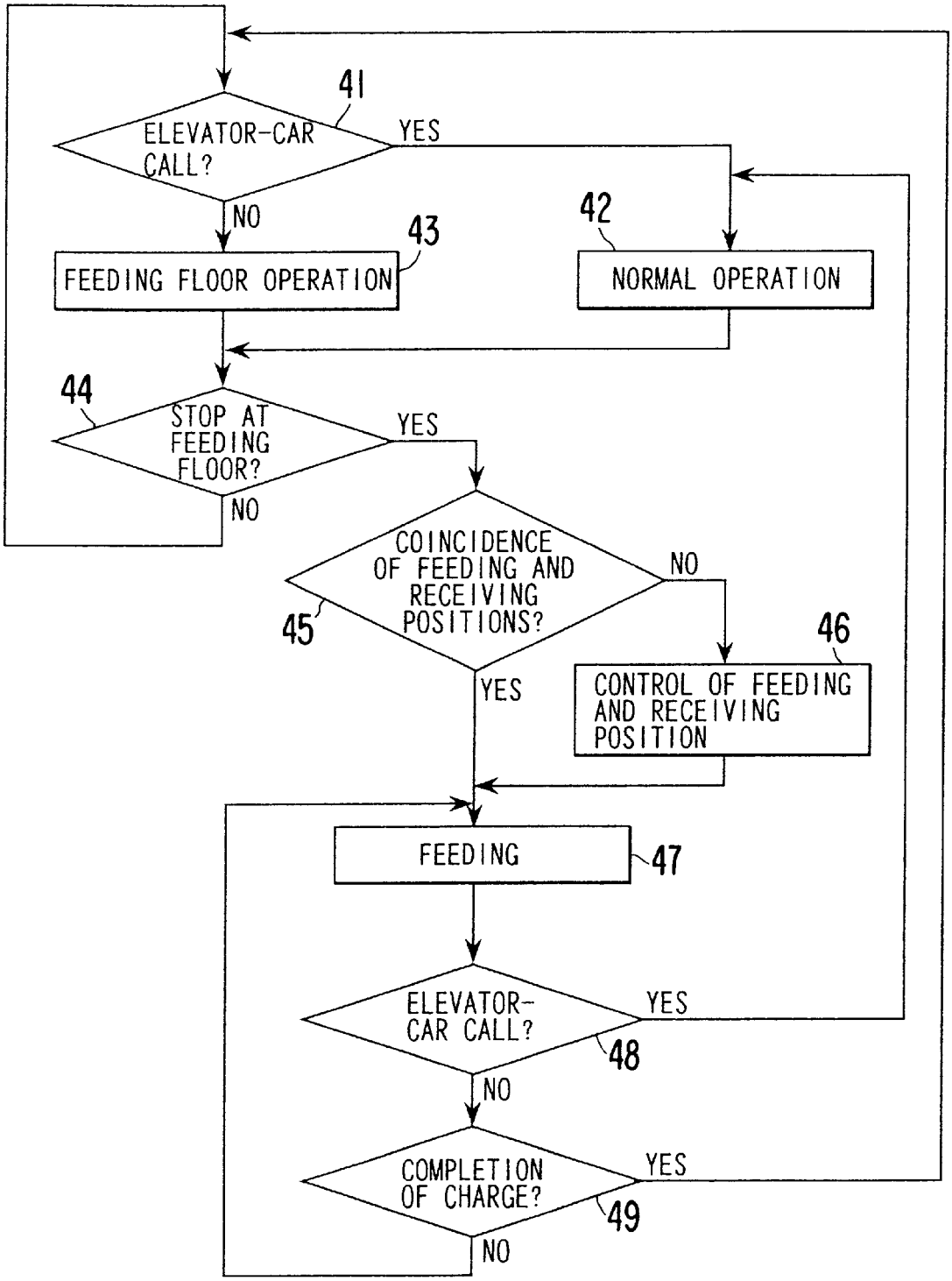
FIG. 4 is a flow chart illustrating the operation and the feeding of power in an elevator system according to the embodiment.

FIG. 4 is a flow chart illustrating the operation of feeding electric power to elevator according to the embodiment of the present invention.

First, it is judged at step 41 whether or not there is an elevator-car call. If an elevator-car call has been generated, then the elevator-car is driven in a normal operation (step 42). If there is no elevator-car call for a predetermined period of time and it is judged that the elevator is in an off time, then the elevator-car is driven in a feeding floor operation (step 43).

The term "feeding floor operation" refers to an operation for the movement of the elevator-car to the feeding floor, i.e. to the floor where the counter weight is positioned so that electric power can be supplied from the feeding unit 131 to the receiving unit 113. In this feeding floor operation, elevator-car call information is transferred from the communications unit 132 of the feeding unit 13 to. the elevator control unit 116 of the control panel 11 shown in FIG. 2 via a communications unit 117. Further, a command for moving the counter weight so that the elevator-car is driven to the feeding floor is given from the elevator control unit 116 to the motor control unit 112. As a result, the inverter 111 drives the motor 10. When approaching the feeding floor, position information is given from the communications unit 132 of the feeding unit 13 shown in FIG. 2 to the elevator control unit 116 via the communications unit 117, and the motor control unit 112 stops the motor 10.

When the elevator-car stops at the feeding floor (step 44), it is judged in step 45 whether or not the positions of the feeding unit and the receiving unit are coincident with each other. If not coincident, a feeding and receiving position control is carried out in step 46 to cause the positions to coincide. Namely, the feeding unit 131 and the receiving unit 113 are positioned by moving the counter weight. When positioning the feeding unit and the receiving unit, the position of the elevator-car may be displaced. It is determined that there is no passenger in the elevator-car because it has already been determined that there has been no elevator-car call for a predetermined period of time. However, in order to increase the safety of this operation, the feeding and receiving position control according to this embodiment is carried out when a sensing means for detecting passengers confirms that there is no passenger in the elevator-car.

If the positions of the feeding unit 131 and the receiving unit 113 are coincident with each other, then the feeding operation is started at step 47. The operation of moving the counter weight is performed by using the communications units 132 and 117, the elevator control unit 116, the motor control unit 112, the inverter 111 and the motor 10 in a way similar to that of the control system shown in FIG. 2. During the feeding operation, electric power is supplied from the feeding unit 131 to the receiving unit 113, and thus the battery is charged. The feeding operation is continued until an elevator-car call is received (step 48), or until the battery on the receiving unit side is fully charged (step 49).

The normal operation and the power feeding operation are performed without interruption of normal operations by the above-mentioned sequence, so as to not disturb the normal function of the elevator system.

Because the displacement between the stopping place of the elevator-car and the stopping place of the counter weight can be measured in accordance with this embodiment, a measure of the rope expansion can be obtained by using this result. Therefore, it is possible to inform the elevator manager and the maintenance personnel of the necessity of rope adjustment or replacement.

According to the above-mentioned embodiment, it is possible to effect control so that the receiving transformer winding may be correctly and accurately aligned with the feeding power transformer winding by using the position sensor. Therefore, the counter weight is stopped at the power feeding position with a high degree of accuracy even if there is a rope expansion, and it is possible to efficiently feed electric power to the counter weight side.

In the above-mentioned embodiment, both the feeding unit and the receiving unit were positioned by vertical movement of the counter weight. However, it may be possible to position them by vertically moving only one of the receiving unit and the feeding system. In this case, there is an effect that the electric power required to move the unit may be reduced, because the moving part becomes small.

Because this embodiment uses a configuration in which regenerative electric power is returned to the battery 114, if the elevator moves up and down, it is placed in the regenerative mode in either of upper and lower movement.

Accordingly, even if the feeding power time is not so long, efficient operation is possible in practical use because the electrical discharge from the battery is small.

Further, during the times when the passenger traffic in the same direction increases continuously, for instance, at the times that people are going to work or returning from one's office, etc. in the office building, the elevator-car is always operated in a power mode. For such a case, the capacity of the battery may be set in consideration of the maximum amount of the power consumption, or a plurality of the feeding units may be provided in connection with a plurality of feeding floors. Thereby, the effective feeding time can be increased. Although the position sensor was separately installed in the above-mentioned embodiment, it is also possible to detect the position by using the characteristic of the transformer itself. Such an example will be explained as follows.

Figure 5A:
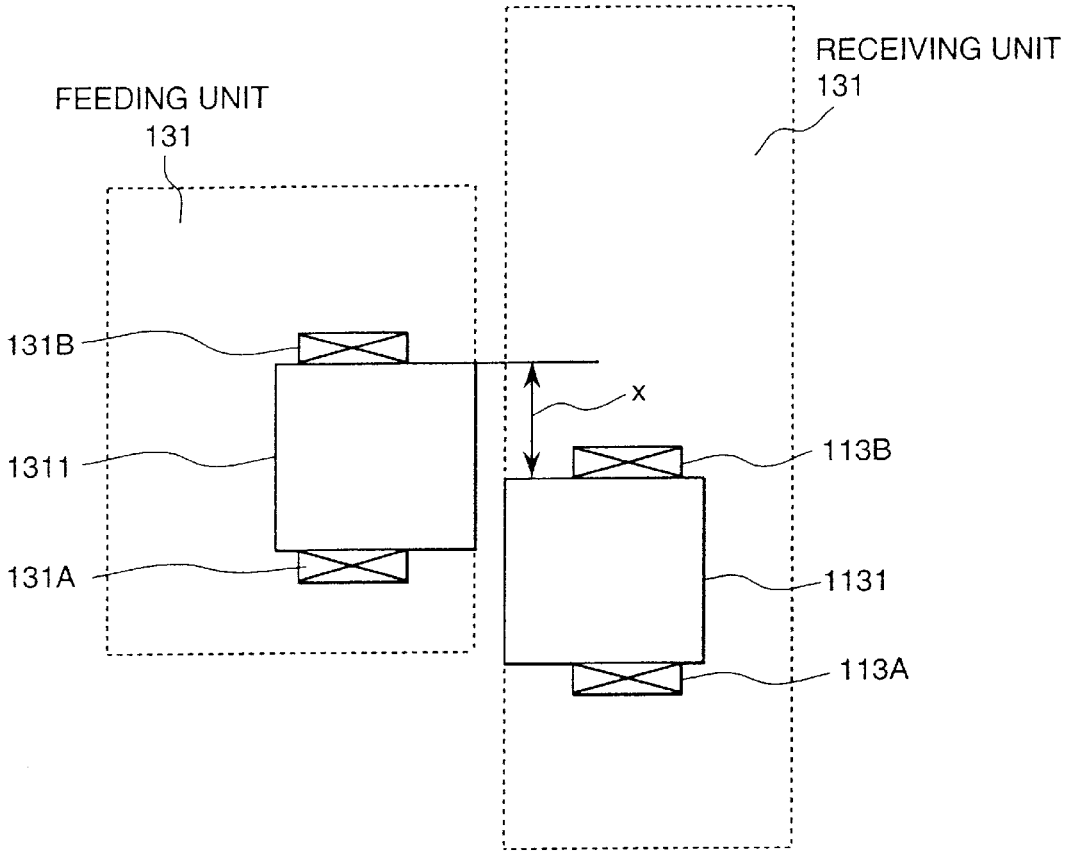
FIG. 5A is a schematic diagram showing the section of a feeding system 131 and a receiving unit 113 according to another embodiment of the invention.
Figure 5B:
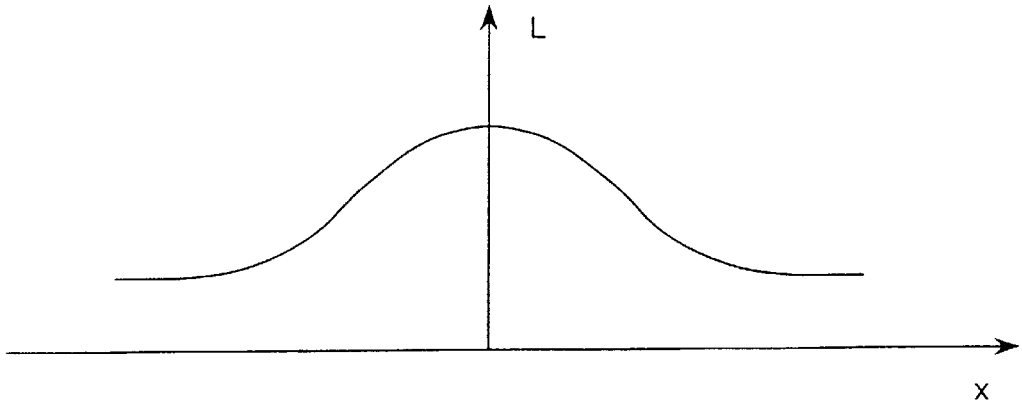
FIG. 5B is a graph showing the characteristic of a transformer according to another embodiment.

FIG. 5A is a schematic diagram showing the section of a feeding unit 131 and a receiving unit 113 according to another embodiment of the invention. FIG. 5B is a graph showing the characteristic of a transformer according to another embodiment, in which self-inductance L when the voltage with a constant frequency and a constant amplitude is applied to the transformer was plotted with respect to the displacement x.

The self-inductance L decreases, because the main magnetic flux may decrease, when the positions of the transformers are non-aligned. Therefore, the transformers will be aligned correctly at the position where the self-inductance L becomes the maximum. The aligned position can be detected by using this principle, in practice, by measuring the phase difference between the voltage and the electric current. It is not required to provide a position sensor according to such a method. Therefore, there is an effect that the configuration becomes simple and the cost is reduced.

Figure 6:
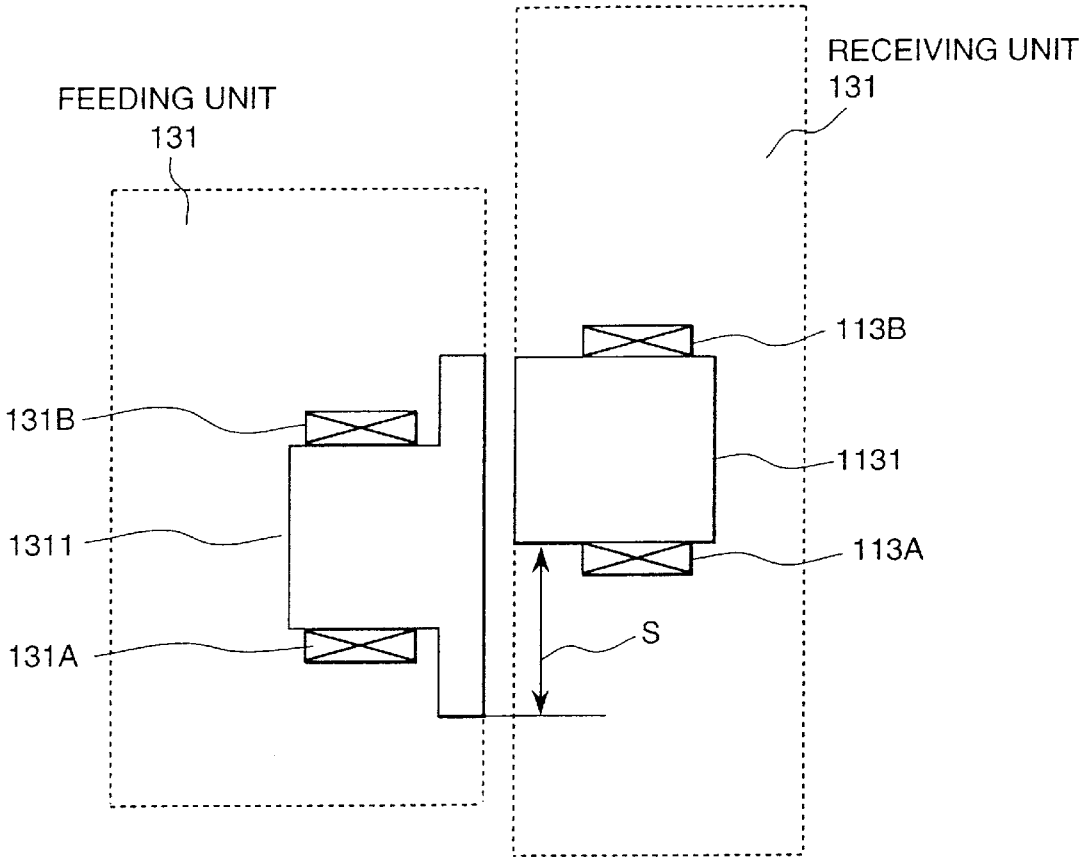
FIG. 6 is a schematic diagram showing the section of a feeding system 131 and a receiving unit 113 according to another embodiment.

FIG. 6 is a schematic view showing the section of a feeding unit 131 and a receiving unit 113 according to another embodiment. In this embodiment, the gap side core length of the feeding transformer winding 1311 on the feeding unit side is elongated. This core length is almost equal to the sum of the maximum rope expansion length L and the gap side core length of the receiving transformer winding 1131 on the receiving unit side. As a result, even when the receiving transformer winding 1131 deviates in position due to rope expansion, it does not become misaligned with the feeding transformer winding 1311, and the transfer characteristics according to the required design can be obtained. Here, the maximum rope expansion length L means the maximum aging length in the maintenance interval when the length of the rope is adjusted. For example, the length is between 100 mm and 200 mm in an elevator system in which the travel length of the elevator-car is approximately 60 m.

In this embodiment, some characteristics decrease, because there is a useless core part in the feeding side transformer winding. However, the structure exhibits a stable characteristic with respect to rope expansion. Further, it becomes possible to construct the elevator system simply, because it is not required to carry out a point-to-point control of the position of the counter weight, as required in the previous embodiment.

In this embodiment, the core of the transformer has a uniform shape in a vertical direction in which the elevator-car is moved, as understood from FIG. 6. Therefore, the magnetic characteristic does not change due to the displacement. In other words, when a core of the C type or E type, etc. is used, it is important to arrange the core so that the ditch may become vertical. As for this, because the influence of the displacement is small, it is desirable to use a similar arrangement even when the counter weight is positioned.

Figure 7:
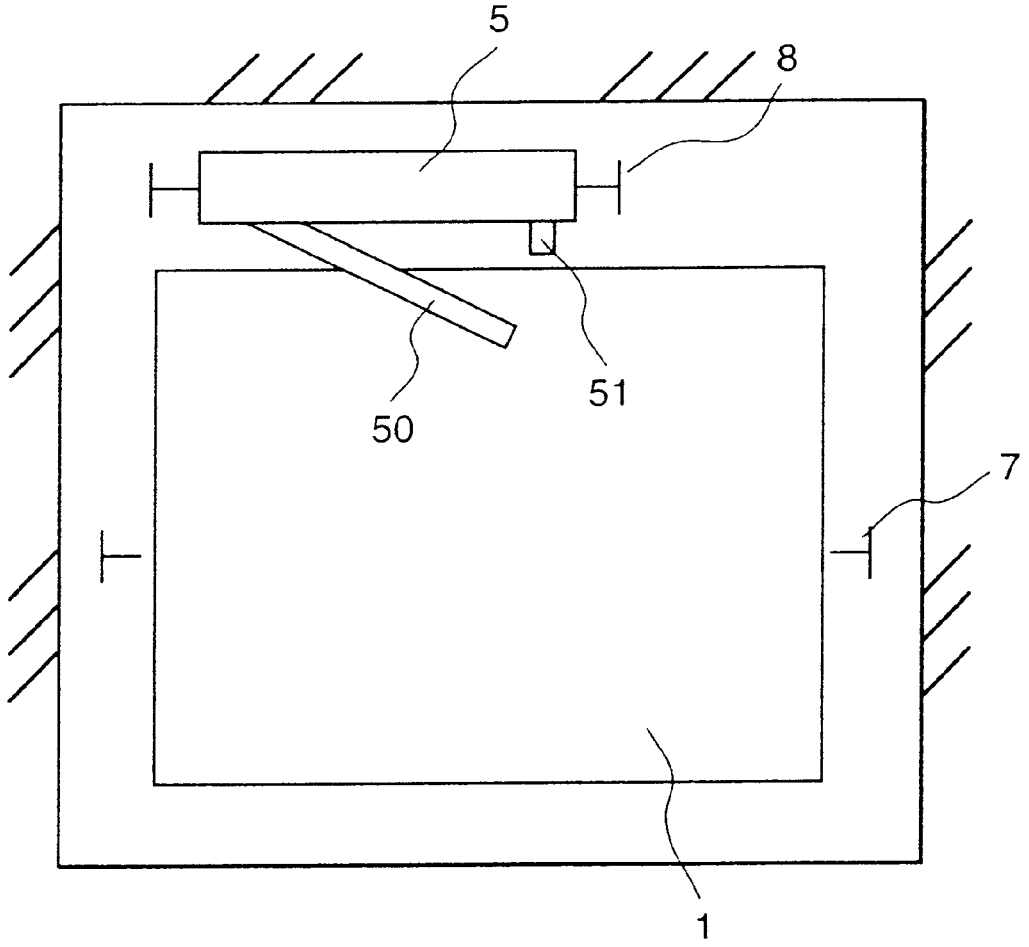
FIG. 7 is a top view of an elevator according to another embodiment.

FIG. 7 is a top view of an elevator system according to another embodiment. In this embodiment, to protect the internal equipment from dust in the hoistway, the motor control unit 112 installed in the counter weight 5 is enclosed in a housing. A movable or detachable check door 50 is provided in the housing and on the opposite side from the wall of the hoistway. A safety unit 51 is installed on this check door 50 so that a switch will operate in the case of an open door to stop the operation of the elevator.

Figure 8:
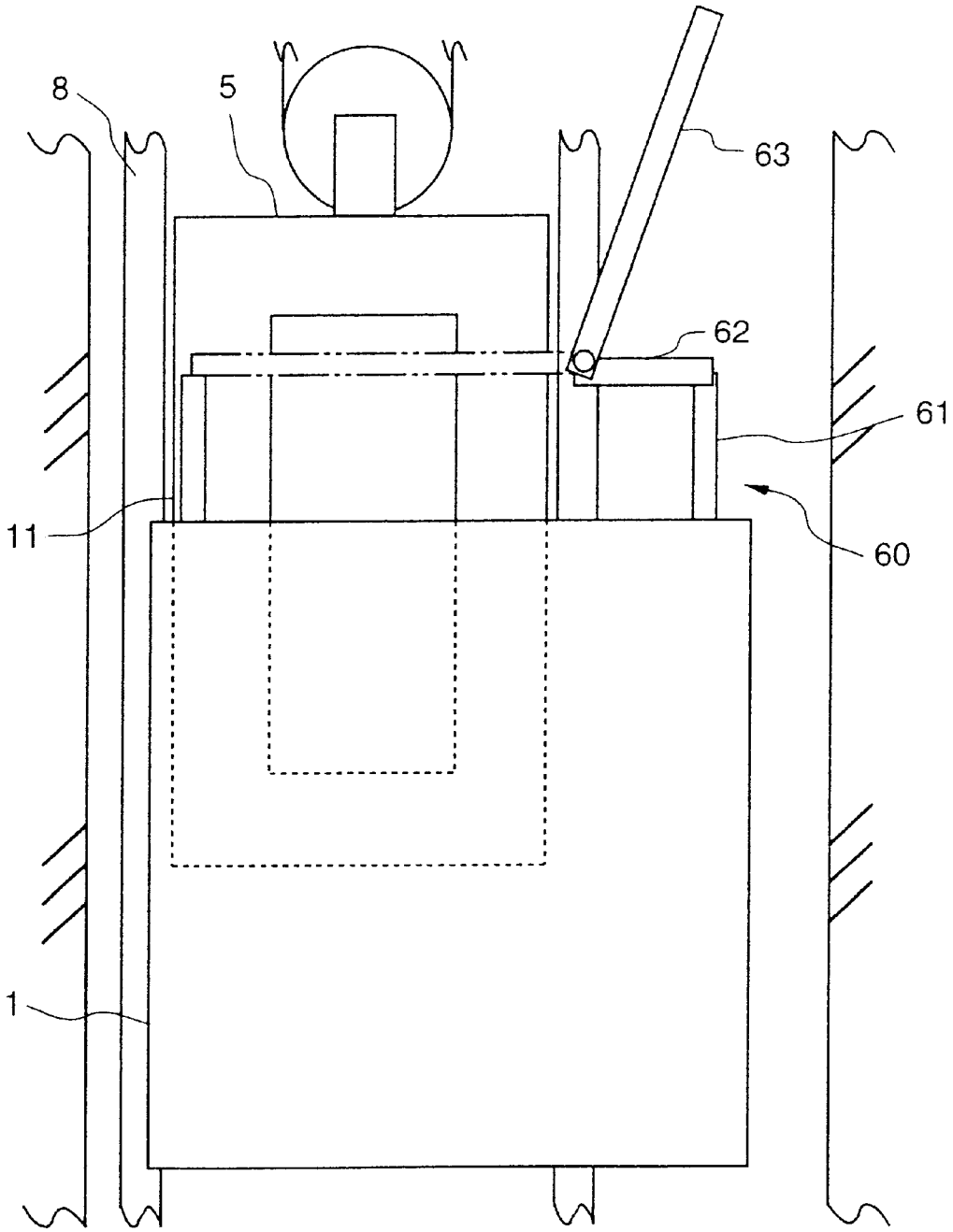
FIG. 8 is a front elevation of the elevator shown in FIG. 7.

FIG. 8 is a front elevation of the elevator system shown in FIG. 7. In this embodiment, a handrail 60 with some height is provided in the plane of the elevator-car on the upper part of elevator-car 1. As for this handrail 60, crossbars 62 and 63 are fixed to a pillar 61. Crossbar 63 on the counter weight side is installed so as to be pivotable in an up direction.

The control unit 11, which is installed in the counter weight, is checked as follows. The elevator is made to go up and down after boarding on the ceiling of the elevator-car 1 or standing in the pit on the bottom of the hoistway. The elevator-car is stopped so that the counter weight 5 may come to the appropriate position, and then the check is started. In this case, check door 50 installed on the opposite side from the wall of the hoistway is opened and the control unit 11 installed in the counter weight 5 is checked.

Further, when the worker boards the ceiling of the elevator-car 1 and works, the worker can use the handrail 60 installed on elevator-car 1 to prevent him from falling while the counter weight is made to go up and down to an appropriate position. The crossbar 63 of the handrail 60 on the counter weight side is moved to a position where does not become obstructive while work is being carried out. The check door 50 projects to the elevator-car side. However, the safety unit 51 operates, and thus the elevator does not go up and down while the check door 50 is open.

By using the above-mentioned configuration, it is possible to safely check the system even if the counter weight includes the control unit etc. to be checked.

Figure 9:
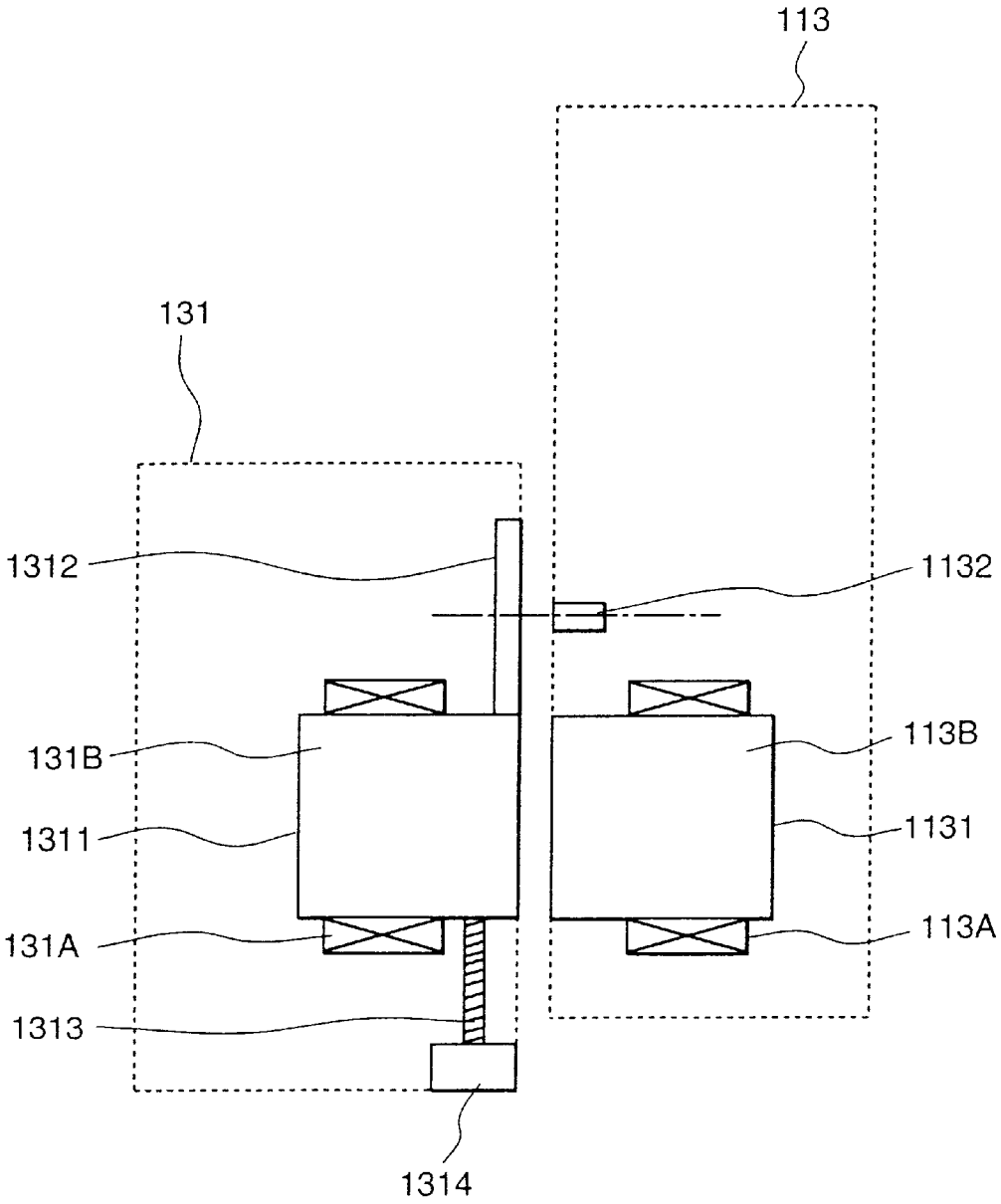
FIG. 9 is a schematic diagram showing the section of a feeding system 131 and a receiving unit 113 according to a further embodiment.

FIG. 9 shows the configuration of the feeding unit 131 and the receiving unit 113 according to another embodiment of the present invention. In the configuration shown in FIG. 9, the mechanism to move the feeding unit itself in up and down directions is added to the configuration shown in FIG. 3. The mechanism comprises a ball screw 1313 for moving the transformer unit 1311 in up and down directions, and a motor 1314 for rotating the ball screw. The motor 1314 is driven according to the displacement detected by a position sensor 1312 to suppress the displacement of the feeding unit.

While the feeding side of the elevator system has been moved in up and down directions in this embodiment, it may be possible to move the receiving side of the elevator system. Further, while the sensor is provided on the receiving side, it may be possible to provide it on the feeding side of the elevator system. These arrangements can be changed according to the configuration of the system.

What is claimed is:

1. An elevator in which an elevator-car and a counter weight are hung like a draw well, comprising:

a receiving means for receiving an electric power from a feeding means provided in a hoistway, an inverter for converting the received electric power into ac power, a motor connected to an ac side of said inverter, for driving said counter weight in up and down directions, a means for detecting a position of said receiving means; and a means for controlling an inverter on the basis of the position detected by said position detecting means;

wherein said counterweight has said receiving means, said inverter, and said motor.

2. An elevator in which an elevator-car and a counter weight are hung like a draw well, comprising:

a receiving means for receiving an electric power from a feeding means provided in a hoistway, an inverter for converting the received electric power into ac power, a motor connected to an ac side of said inverter, for driving said counter weight in up and down directions, a means for detecting a position of said receiving means, and a means for controlling an inverter so that said receiving means may be arranged at a position where an electric power can be supplied from said feeding means, on the basis of the position detected by said position detecting means, wherein said counterweight has said receiving means, said inverter, and said motor.

3. An elevator in which an elevator-car and a counter weight are hung like a draw well, comprising:

a receiving means for receiving an electric power from a feeding means provided in a hoistway, an inverter for converting the received electric power into ac power, a motor connected to an ac side of said inverter, for driving a said counter weight in up and down directions, a means for detecting a position of said receiving means; and a means for controlling an inverter so that said feeding means may be moved at a position where an electric power can be supplied to said receiving means, on the basis of the position detected by said position detecting means;

wherein said counter weight has said receiving means, said inverter, and said motor.

4. An elevator in which an elevator-car and a counter weight are hung like a draw well, comprising:

a receiving means for receiving an electric power from a feeding means provided in a hoistway, an inverter for converting the received electric power into ac power, a motor connected to an ac side of said inverter, for driving said counter weight in up and down directions, a means for detecting positions of the feeding means and the receiving means; and a means for controlling said inverter on the basis of the positions detected by said position detecting means;

wherein said counterweight has said receiving means, said inverter, and said motor.

5. An elevator in which an elevator-car and a counter weight are hung like a draw well, comprising:

a receiving means for receiving an electric power from a feeding means provided in a hoistway, an inverter for converting the received electric power into ac power, a motor connected to an ac side of said inverter, for driving said counter weight in up and down directions, a means for detecting a position of said receiving means; and a means for controlling an inverter so that the displacement between the position of said feeding means and one of said receiving position is reduced, on the basis of the position detected by said position detecting means;

wherein said counter weight has said receiving means, said inverter, and said motor.

6. An elevator in which an elevator-car and a counter weight are hung like a draw well, comprising:

an inverter for converting the received electric power into ac power, a motor connected to an ac side of said inverter, for driving said counter weight in up and down directions, and a control panel for controlling an inverter, wherein said counterweight has said inverter, said motor, and said control panel, and wherein said control panel has a check door on the opposite side of the wall of the hoistway.

7. An elevator according to claim 6, further comprising a means for stopping said counter weight in response to the open operation of said check door.

8. An elevator in which an elevator-car and a counter weight are hung like a draw well, comprising:

a receiving unit for receiving an electric power from a feeding unit provided in a hoistway, an inverter for converting the received electric power into ac power, a motor connected to an ac side of said inverter, for driving said counter weight in up and down directions, and a detector for detecting a position of the receiving unit, wherein said inverter is controlled so that said receiving unit may be arranged at a position where an electric power can be supplied from said feeding unit, on the basis of the position detected by said position detector, wherein said counter weight has said receiving unit, said inverter, and said motor.

9. An elevator in which an elevator-car and a counter weight are hung like a draw well, comprising:

a receiving unit for receiving an electric power from a feeding unit provided in a hoistway, an inverter for converting the received electric power into ac power, a motor connected to an ac side of said inverter, for driving said counter weight in up and down directions, and a detector for detecting a position of the receiving unit, wherein said inverter is controlled so that said feeding unit may be moved at a position where an electric power can be supplied to said receiving unit, on the basis of the position detected by said position detector, and wherein said counter weight has said receiving unit, said inverter, and said motor.

* * * * *